United States Patent [19]

Malone

[11] Patent Number: 4,681,332

[45] Date of Patent: Jul. 21, 1987

[54] MOBILE VEHICLE FOR TRAINING SKATERS

[75] Inventor: Don Malone, Martin, Tenn.

[73] Assignee: University of Tennessee Research Corporation, Knoxville, Tenn.

[21] Appl. No.: 865,535

[22] Filed: May 21, 1986

[51] Int. Cl.[4] ..... A63C 3/04

[52] U.S. Cl. ..... 280/87.02 R; 272/70.3; 280/1.1 R; 280/826; 297/5

[58] Field of Search ..... 280/87.01, 87.02 R, 280/87.02 W, 87.05, 12.1, 23, 1.1 R, 1.181, 1.182, 1.183, 1.184, 79.2, 87.04 R, 826; 297/5, 6; 272/70.3, 70.4

[56] References Cited

U.S. PATENT DOCUMENTS

| | | | |
|---|---|---|---|
| 1,498,677 | 6/1924 | Bemis et al. | 280/1.1 R |
| 1,622,108 | 3/1927 | Hawkinson | 280/87.05 |
| 2,423,590 | 7/1947 | Fageol | 280/87.02 R |
| 2,530,544 | 11/1950 | Schwantes | 280/87.02 R |
| 3,180,678 | 4/1965 | McCabe | 297/5 |
| 3,183,028 | 5/1965 | Williams | 272/70.3 |
| 3,235,254 | 2/1966 | Robson | 272/70.3 |
| 3,730,524 | 5/1973 | Green | 280/87.02 R |
| 4,018,439 | 4/1977 | Kauk | 272/70.3 |
| 4,065,145 | 12/1977 | Chambers | 280/87.02 R |

FOREIGN PATENT DOCUMENTS

| | | | |
|---|---|---|---|
| 919056 | 2/1963 | United Kingdom | 272/70.3 |

*Primary Examiner*—David M. Mitchell
*Attorney, Agent, or Firm*—Luedeka & Neely

[57] ABSTRACT

A mobile vehicle for training beginning skaters is provided which has a fixed handlebar and seat mounted above a straddlebar extending between the two. The straddlebar is rigidly fixed to front and rear legs which are rigidly mounted to a wide and long base comprising two horizontal transverse base bars having swivelling caster wheels at their outer ends. The rear leg extends downward and considerably to the rear. The vehicle permits a beginning skater to train in a relatively uninhibited manner with support from a fall forward by the handlebars and skate toes and support from a rearward fall by the seat.

15 Claims, 9 Drawing Figures

MOBILE VEHICLE FOR TRAINING SKATERS

This invention relates to a mobile vehicle for training beginning skaters which permits skaters to move in a relatively uninhibited manner but catch themselves on either a forward or rearward fall.

A beginning skater runs the risk of injury which is worse in the case of an adult given an adult's weight and distance to the floor which can be very hard in some skating rinks. The normal solution to the problem is free instructions on the fine art of falling. The patent literature shows some support devices which are not believed to be in common use, and some rinks still have a rail around them, but the presence of a rail is becoming less common. Skaters do fall. Even good skaters fall, frequently tripping over bad skaters. It is not uncommon to see grown mean and women hanging on to rails when available with obvious panic.

The present invention measurably reduces the possibility of injury. The skater straddles it and if the skater loses balance and falls forward, the handlebars provide a support, together with the toestops of his skates. In a fall backward, the skater comes to rest on the seat. The base of the present invention is wide enough and long enough to eliminate the danger of overturning. The vehicle is not steered in the manner of a bicycle, even though it has handlebars. Instead, the change of direction is facilitated by four swivel casters on the base which readily respond to pressure exerted in any direction. While the mobile training vehicle of the present invention is height adjustable, the legs adjust and not the seat. If the seat is raised too high, it causes the frame to get in the skater's way when turning corners. Likewise the straddlebar must be fairly small in width so as not to get in the way during the skating activity especially on turns. The seat must be relatively close to the straddlebar. While the vehicle is adjustable to accommodate different sizes of skaters, the range is such that usually two sizes are best used—one, an adjustable large size which is described more specifically in the description below and a smaller size of the same proportions to accommodate children down to the age of four.

The mobile vehicle of the present invention provides a beginner with confidence against falls to accelerate the learning process.

The vehicle is designed for rigidity, simplicity in manufacture and while built to last, is sufficiently economical to permit skating rink operators to rent to beginners.

Of great significance is to provide a stable wide and long base that does not readily inhibit the skater from going through the normal skating routines, especially involving turns. To this end, it is to be noted that the straddlebar, which looks somewhat like a bicycle, has a relatively steep angle downward to the rear as opposed to the more horizontal arrangement of a bicycle. Even of greater significance, is that the rear leg extends a considerable distance to the rear to avoid any interference with the skater.

Various additional embodiments of the vehicle include a motor driven adjustment version and a version having a surrounding bumper. The surrounding bumper permits several vehicles to be used in the same beginner's part of a skating rink, since the bumpers collide with bumpers and not with ankles of other skaters.

Thus, it is the object of this invention to provide a mobile vehicle for training beginning skaters that will reduce or break any falls both to the rear and forwardly that permits the skater to be relatively uninhibited in the skating activities while learning.

Other objects and advantages of the invention will become apparent by reference to the following description including the accompanying drawings in which.

Figure 1:
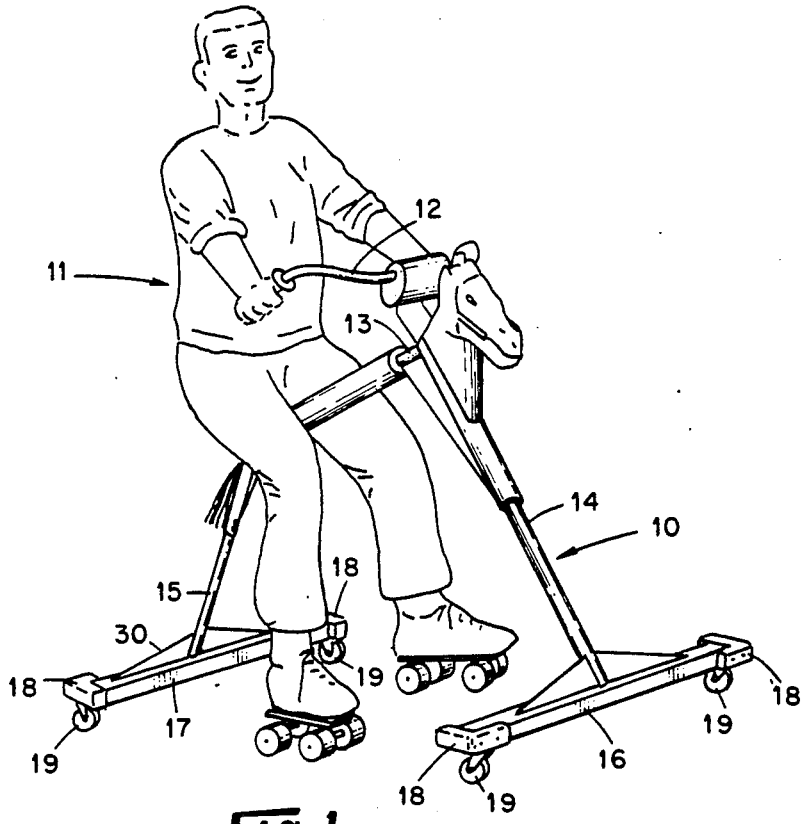
FIG. 1 is a perspective view of the invention with a skater thereon and foam pads on the straddlebar and handlebar.
Figure 2:
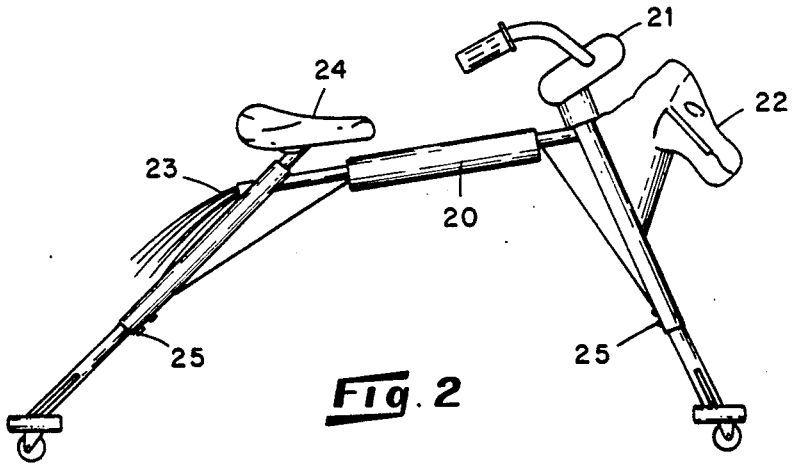
FIG. 2 is a sideview of the vehicle in FIG. 1 without the skater.
Figure 3:
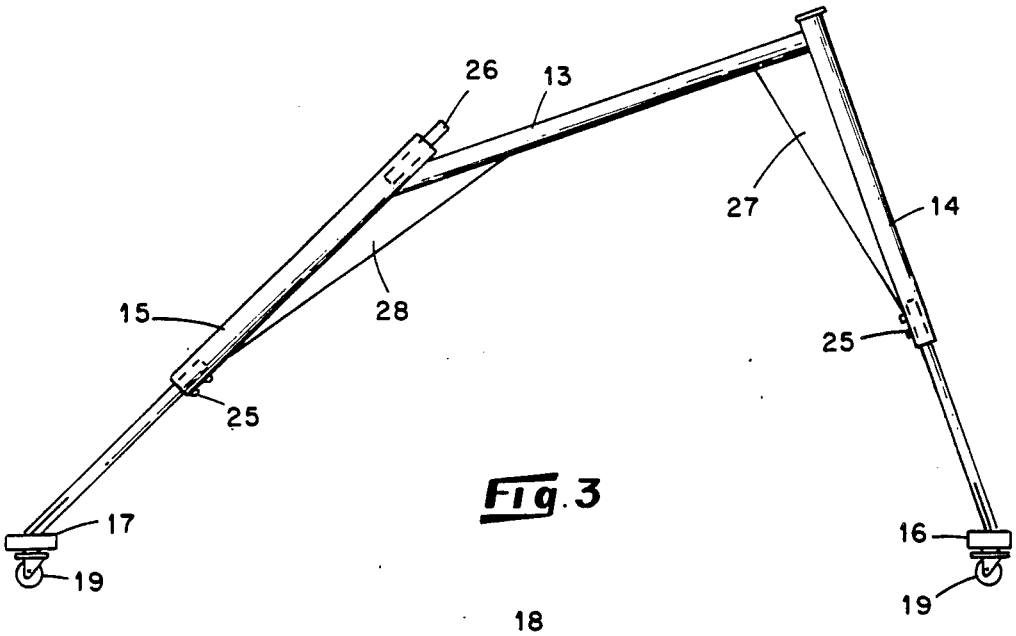
FIG. 3 is a sideview of the vehicle in greater detail similar to the view of FIG. 3 minus the foam pads, seat, handlebar and horse's head and tail.

Referring now to the drawings in further detail, a preferred embodiment is shown in FIGS. 1–5 wherein the mobile training vehicle 10 has a skater 11 seated thereon. While the skater is shown with roller skates, he could equally be using the mobile vehicle with ice skates. The vehicle has a handlebar 12, straddlebar 13, frontleg 14, rearleg 15 and a wide base provided by a front horizontal basebar 16 and rear horizontal basebar 17. Each end of the horizontal basebars are provided with small bumpers 18 made of a soft material to keep the ends of the basebars from scratching or cutting or otherwise injuring other skaters or equipment. Underneath each basebar at its outer ends is provided a precision swivel caster wheel 19. The basebars are 26 inches long and the horizontal spacing of the swivel wheels is approximately two feet. The wheels swivel in any direction the skater desires to go and are usable on ice as well as other skating surfaces. The wheels may be of larger size and could be of semi-pneumatic tires. The vehicle may have foam pads 20 on the straddlebar and foam pads 21 on the handlebar. The vehicle may be decorated with a horse's head 22 and tail 23. At the top of front leg 14 there is fixed a bicycle-like seat 24. It is designed so that the seat is fixed as to height but may be otherwise swiveled for adjustment to the comfort of the skater which is typical of bicycle-like seats. The adjustment as to height of the vehicle is provided by the front leg and rear leg being telescoped and locked in place by set screws 25. With special reference to FIG. 3, there is shown the basic relationships of the proportions and the angles of the front legs, straddlebar, and rear legs. FIG. 3 shows a saddle post 26, a front reinforcing gusset 27 and a rear reinforcing gusset 28.

Again with specific reference to FIG. 3 and since the angles and proportions are of importance to the invention, the specific dimensions and angles for a vehicle designed for a wide range of adults and larger children is now provided. The upper part of both the front and rear legs and the straddlebar are made of strong one-inch diameter steel tubing. The lower part of the front and rear legs is made of strong steel tubing 0.84 inches in diameter which is designed to telescope into the upper part of the front and rear legs. In FIG. 3 this telescoping is shown in its most extended position which requires that there remain a minimum of two inches of telescope tubing, one into the other, to give a sufficiently strong joint which is held in place by two set screws. These set screws are on each of the front and rear legs and are made from $\frac{3}{4}$ inch bolts screwed into nuts tack welded to the upper leg.

The straddlebar is 26 inches long and it is at a relatively steep angle compared to bicycle straddlebars. The seat post is welded in place so that it is not adjustable to height and is of a size to accommodate bicycle-like seats. The handlebar (not shown) is similar to a bicycle handlebar but is not designed to swivel and is mounted into the top part of the front leg similar to the mounting as though it were a bicycle handlebar. The upper part of the front leg is 20 inches long and the lower part of the front leg, including the minimum two inches of telescoping portions, is 21 inches long. This permits an adjustment range of 15 inches. The upper part of the rear leg is likewise 20 inches long with the lower portion of the rear leg, including the two-inch minimum telescoping portion, is 22 inches long. The inside angle between the front and the straddlebar is 104 degrees and the inside angle between the straddlebar and the rear leg is 144 degrees. This configuration provides for the bottom portion of the front leg to be 16 inches forward from the straddlebar and the rear leg to be 28 inches to the rear of the straddlebar when fully extended. It also provides that the straddlebar is five inches lower at the rear than it is at the front. When contracted the rear leg is 16 inches to the rear and the front leg 8.5 inches to the front.

It is important that the rear leg extend substantially to the rear to the extent shown because otherwise the skater would be encumbered in his regular skating activities. Likewise, the relatively steep angle of the straddlebar and the closeness of the seat to the straddebar provide for a more natural freedom of movement for the skater. It is important that the straddlebar not be of a substantially greater diameter than that shown so as to permit the skater to make turns crossing his feet and similar maneuvers. It is necessary that the vehicle be strong and rigid so as to provide the skater the support needed to break a fall. Since the tubing is of a relatively small diameter and stretched out for a relatively elongated base, the front and rear reinforcing gussets or braces are important. The front brace extends down the straddlebar four inches and down the front leg 15 inches and is welded in place from $\frac{1}{8}$ inch thick steel plate. The rear reinforcing gusset or brace extends along the straddlebar ten inches and down the rear leg 15 inches and is welded to both members from $\frac{1}{8}$ inch steel plate.

While the specific dimensions are the preferred embodiment for most skaters, and is adjustable to their needs, for small skaters down to the age of four, a similarly configured version of smaller dimensions may be provided. This would have to do more with the height of the vehicle and the necessary strength which would be less because of the lesser weight of the smaller skaters. However, the relative angles and proportions would still prevail.

Figure 4:
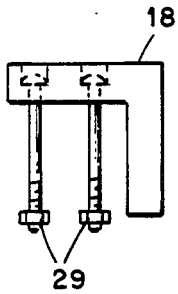
FIG. 4 is a detailed sideview of the small bumper used in FIG. 3.

With reference to FIG. 4 there is shown the details of the small bumper 18 which is one-inch thick and four inches on the side. The bumper is secured by two 3-inch bolts 29 to the outer end of the front and rear horizontal basebars 16 and 17 so as to provide for a bumper that extends outward from the base.

Figure 5:
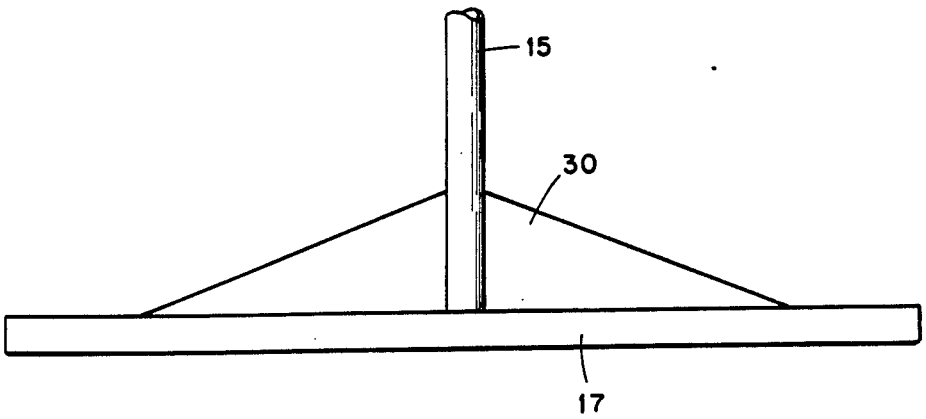
FIG. 5 is a detailed view of the reinforced joint between the leg brace and transverse basebars.

With special reference to FIG. 5, there is shown the details of the reinforcing between the legs and the horizontal basebars which are identical for each leg but for purposes of illustration, the rear leg is chosen. There is shown a rear leg 15 welded to rear horizontal basebar 17 which is 26 inches long and made from 1-inch by 2-inch steel tubing. The basebar reinforcing gusset or brace 30 extends along the horizontal basebar 15 inches and is welded there too. It is made from $\frac{1}{8}$ inch steel plate of a single piece and it is welded $3\frac{1}{2}$ inches along the leg.

Figure 6:
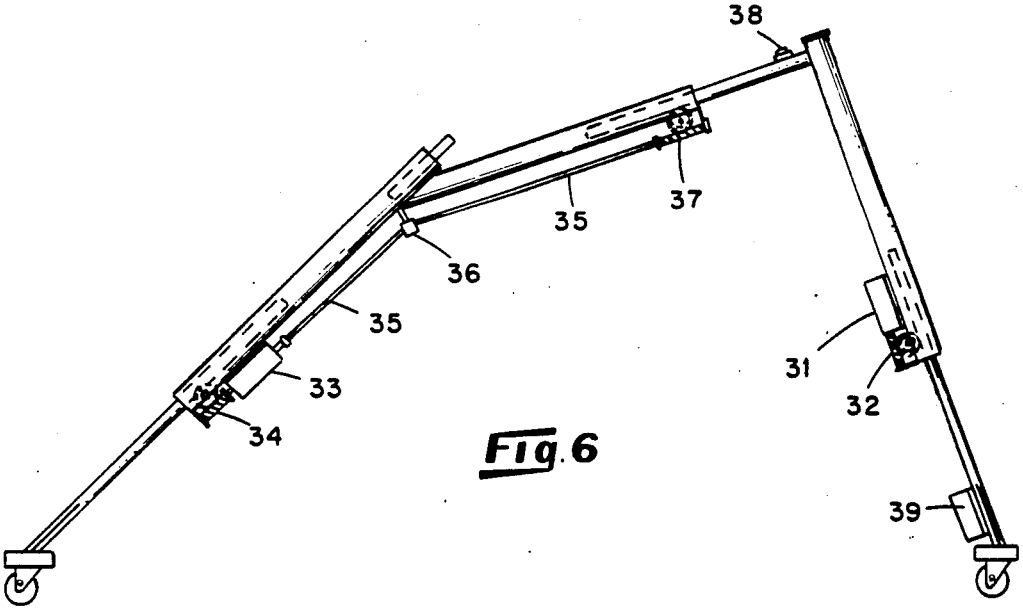
FIG. 6 is a sideview of a second embodiment similar to the view in FIG. 3 showing schematically a motorized adjustment for the legs and straddlebar.

With reference to FIG. 6, there is shown a second embodiment that is motorized for adjustment. A reversible battery-driven motor 31 is provided for the front leg to drive a worm gear 32 which mates with the lower part of the front leg to adjust it up and down. The reversible motor is affixed to the upper part of the front leg. Likewise, a battery-driven reversible motor 33 is affixed to the upper part of the rear leg and drives both a worm gear 34 and a double shaft 35. The worm gear 34 mates with the lower part of the front leg to telescope it in and out as the worm is activated. The double shaft is in two portions supported along its midsection by a shaft hanger 36 and drives a straddle bar worm gear 37 which causes the straddlebar to telescope in and out for adjustment as to its length. In this case the straddlebar is divided into two sections with the rearmost section being of sufficient diameter to permit the forward section to telescope within it and yet provide the rigidity and strength necessary for the vehicle. Both reversible motors are driven by a common rechargeable battery 39 when switch 38 is activated. The connecting wires between the switch, battery and reversible motors are not shown. The switch is of a type that in one position causes all of the motors to rotate in one direction so as to cause the trainer to telescope to a larger size and in another direction to cause the trainer to telescope to a smaller size, with an inbetween off position. The relationship between the worm gear and the inner telescoping members is a rack and pinion type of arrangement. The adjustments are all carried out simultaneously and the back leg adjustments has a range of 16.5 inches and a front leg adjustment of 15 inches with the saddlebar adjusting $\frac{1}{3}$ as much as the back leg adjustment or a maximum of 5.5 inches. The ratio between these adjustments is maintained constant by the choice of gear arrangements and drive speed, which is at a low RPM, of the reversible motors.

Figure 7:
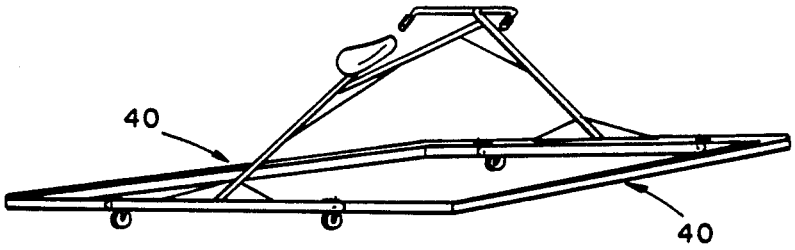
FIG. 7 is a perspective schematic view of the vehicle with a protective surrounding bumper frame.
Figure 8:
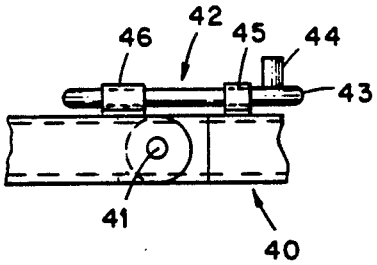
FIG. 8 is a broken away sideview showing a latching mechanism for holding the surrounding bumper frame in a folded out operative position.
Figure 9:
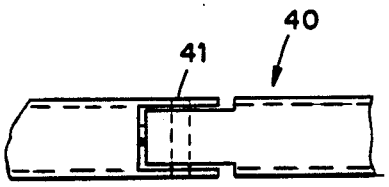
FIG. 9 is a schematic top view minus the latching mechanism to show the pivoting arrangement of the surrounding bumper frame to permit it to fold up for storage.

With reference to FIG. 7, there is shown another modification of the vehicle where a folding surrounding bumper frame 40 is provided. The frame causes the width of the base of the vehicle to be extended from 26 inches out to 52 inches so as to give sufficient room for the skater to move from side to side. Since this width is cumbersome for storage and movement, the frame can either telescope or fold. The preference is for it to fold to the original 26-inch width. The four pivot points are shown in FIG. 7 just outside the wheels. The pivot arrangement is shown in FIG. 9 with a pivot pin 41 fixed to the basebar 16 or 17. The surrounding bumper 40 has an aperature of sufficient diameter to permit it to receive pivot pin 41, about which it pivots. The locking arrangement is not shown in FIG. 9 but is shown in FIG. 8 where pivoted surrounding bumper 40 is locked in the horizontal folded out position by a latch mechanism 42 which consists of a sliding rod 43 with finger grip 44. The latch rod is received in hinge tube 45 welded to the surrounding bumper 40, and hinge tube 46 welded to the basebar. Thus, there are two surrounding bumpers 40 of C-shaped configuration each pivoted in two places to the right and left outermost ends, respectively, of the front and rear basebar. Each C-shaped member can be unlocked and pivoted upwards for storage.

The principal embodiment is unsatisfactory for outdoor use but in that case swiveling pneumatic tires or wheels would be better than the precision swiveling casters shown. The vehicle is not suitable for general skating rink use when regular skaters are using the same part of the skating rink. The training vehicle needs either a separate skating rink or a portion of the skating rink to itself. In this case, a wraparound bumper such as shown in FIGS. 7, 8, and 9 are preferred and all trainers should be provided with them under those circumstances so that the bumpers will collide with bumpers and not with ankles of companion skaters. While one suitable bumper frame surrounding the vehicle has been shown, other versions with different details may be provided for pivoting or telescoping. The bumper does not have to be as strong as the basebars to which they are mounted, but must be sufficiently strong to perform their function.

While a preferred embodiment and modifications of the invention are shown and described, it will be understood that there is no intent to limit the invention by such disclosure, but rather it is intended to cover all modifications and alternate constructions falling within the spirit and scope of the invention as defined in the appended plans.

What is claimed is:

1. A mobile vehicle for training skaters comprising a narrow straddlebar extending forwardly and upwardly;

a front leg attached to the front of said straddlebar extending downwardly and forwardly;

a rear leg attached to the rear of said straddlebar extending downwardly and rearwardly for a considerable distance, said straddlebar being substantially the only structural support said front leg and said rear leg;

a horizontal, transversely extending basebar having a left and right outermost end attached to the bottom end of said front leg;

a horizontal, transversely extending basebar having a left and right outermost end attached to the lower end of said rear leg;

a swiveling wheel attached near said left and right outermost ends of said horizontally extending basebars;

a bicycle-like seat mounted above the top of said rear leg at an elevation adjacent to rear of said straddlebar; and a handlebar attached and fixed against swiveling above the top portion of said front leg.

2. A mobile vehicle for training skaters according to claim 1 wherein said front and rear legs are adjustable as to height.

3. A mobile vehicle for training skaters according to claim 1 where it is decorated with a toy head mounted on said front leg and a toy tail mounted on said rear leg.

4. A mobile vehicle for training skaters according to claim 1 wherein a bumper is attached to the outermost ends of each of said horizontal transversely extending basebars.

5. A mobile vehicle for training skaters according to claim 1 wherein reinforcing gussets are welded between said front leg and said straddle bar at their angle of intersection and between said rear leg and said straddlebar at their angle of intersection.

6. A mobile vehicle for training skaters according to claim 1 wherein said straddlebar is a metal tube approximately one inch in diameter.

7. A mobile vehicle for training skaters according to claim 6 wherein the lower end of said rear leg is to the rear of said straddlebar from approximately 16 inches to approximately 28 inches.

8. A mobile vehicle for training skaters according to claim 7 wherein said straddlebar is approximately five inches higher in the front than in the rear.

9. A mobile vehicle for training skaters according to claim 8 wherein said wheels are spaced transversely approximately two feet.

10. A mobile vehicle for training skaters according to claim 2 wherein said front and rear legs each have a tubular upper section and a tubular lower section telescoping into said upper portion to provide height adjustment.

11. A mobile vehicle for training skaters according to claim 10 wherein a reversible battery-driven motor worm gear assembly is provided on each of said legs to provide for telescoping each leg for motor-driven height adjustment.

12. A mobile vehicle for training skaters according to claim 11 wherein said straddlebar is made of a front section and a rear section telescoping one into the other to provide for size adjustment and includes a gear assembly to power said adjustment simultaneously with the adjustment of said front and rear legs.

13. A mobile vehicle for training skaters according to claim 1 wherein a bumper frame surrounds the sides of said vehicle to fend off collisions with similar vehicles having bumper frames.

14. A mobile vehicle for training skaters according to claim 13 wherein said bumper frames consist of a first C-shaped member pivotally connected to the right ends of said two basebars and a second C-shaped member pivotally connected to said left ends of said two basebars whereby said two C-shaped members can pivot upwards to reduce the width of the vehicle for storage or movement.

15. A mobile vehicle for training skaters according to claim 14 wherein a locking arrangement is provided at each of said pivotal connections.

* * * * *

UNITED STATES PATENT AND TRADEMARK OFFICE

CERTIFICATE OF CORRECTION

PATENT NO. : 4,681,332

DATED : July 21, 1987

INVENTOR(S) : Don Malone

It is certified that error appears in the above-identified patent and that said Letters Patent is hereby corrected as shown below:

Column 1, line 18, "mean" should be -- men --

Column 3, line 28, insert -- leg -- after "front"

Column 4, line 46, "adjustments" should be -- adjustment --

Column 5, line 11, "unsatisfactory" should be -- satisfactory --

Column 5, line 45, after "support" insert -- between --

Signed and Sealed this

Twenty-fourth Day of November, 1987

*Attest:*

DONALD J. QUIGG

*Attesting Officer*

*Commissioner of Patents and Trademarks*